US006657116B1

(12) United States Patent
Gunnerson

(10) Patent No.: US 6,657,116 B1
(45) Date of Patent: Dec. 2, 2003

(54) METHOD AND APPARATUS FOR SCHEDULING MUSIC FOR SPECIFIC LISTENERS

(75) Inventor: Eric A. Gunnerson, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 565 days.

(21) Appl. No.: 09/608,337

(22) Filed: Jun. 29, 2000

(51) Int. Cl.[7] ..... G10H 1/18; G10H 7/00
(52) U.S. Cl. ..... 84/615; 434/307 A
(58) Field of Search ..... 84/609–615, 477 R, 84/478; 434/307 A

(56) References Cited

U.S. PATENT DOCUMENTS 5,616,876 A * 4/1997 Cluts ..... 84/609
5,963,916 A * 10/1999 Kaplan ..... 705/26
6,232,539 B1 * 5/2001 Looney et al. ..... 84/609
6,248,946 B1 * 6/2001 Dwek ..... 84/609
6,295,555 B1 * 9/2001 Goldman ..... 709/219

* cited by examiner

*Primary Examiner*—Jeffrey Donels
(74) *Attorney, Agent, or Firm*—Lee & Hayes, PLLC

(57) ABSTRACT

A music system selects a music library containing multiple music albums, in which each music album contains multiple songs. The system identifies listener preferences associated with a first listener and identifies listener preferences associated with a second listener. A music schedule is generated which contains multiple songs acceptable to both the first listener and the second listener. The music system then plays songs from the music schedule. The listener preferences may include ratings of music albums and ratings of songs contained in the music library.

34 Claims, 9 Drawing Sheets

| 402 Genre | 404 Artist | 406 Album | 408 Song | 410 Pointer |
|---|---|---|---|---|
| Jazz | David Sanborn | Pearls | For All We Know | ID1 |
| Jazz | David Sanborn | Pearls | This Masquerade | ID2 |
| Jazz | David Sanborn | Pearls | Superstar | ID3 |
| Rock | Led Zeppelin | Physical Graffiti | Houses Of The Holy | ID122 |
| Rock | Led Zeppelin | Physical Graffiti | Night Flight | ID123 |
| Rock | Led Zeppelin | Physical Graffiti | Ten Years Gone | ID124 |
| Rock | Van Halen | Diver Down | Dancing In The Street | ID1048 |
| Rock | Van Halen | Diver Down | Happy Trails | ID1049 |
| • | • | • | • | • |
| • | • | • | • | • |
| • | • | • | • | • |

400

Fig. 4

| 502 Listener Name | 504 Artist Name | 506 Album Name | 508 Album Rating |
|---|---|---|---|
| Bob | Utopia | | |
| Bob | Acme Gangsters | | |
| Bob | Van Halen | Diver Down | 5 |
| Bob | Van Halen | 1984 | 2 |
| Bob | Trouble Central | Dogs | 0 |
| Mary | Gold Horses | | |
| Mary | David Sanborn | Pearls | 5 |
| Mary | David Sanborn | Inside | 3 |
| Mary | John Doe | Backroads | 0 |
| • | • | • | • |
| • | • | • | • |
| • | • | • | • |

500

Fig. 5

| 602 Listener Name | 604 Album Artist/Name | 606 Song | 608 Song Rating |
|---|---|---|---|
| Bob | Van Halen/1984 | Jump | 4 |
| Bob | Van Halen/1984 | Panama | 3 |
| Bob | Van Halen/1984 | 1984 | 5 |
| Bob | Van Halen/1984 | I'll Wait | 2 |
| Bob | Van Halen/1984 | House of Pain | 3 |
| Mary | Van Halen/1984 | Jump | 3 |
| Mary | Van Halen/1984 | Panama | 2 |
| Mary | Van Halen/1984 | 1984 | 2 |
| Mary | Van Halen/1984 | I'll Wait | 3 |
| ⋮ | ⋮ | ⋮ | ⋮ |

600

Fig. 6

| 702 Station Name | 704 Station ID | 706 Music Source | 708 Station Listeners | 710 Min. Rating |
|---|---|---|---|---|
| Bob's Songs | bob.wav | Jazz, Van Hal... | Bob | 6 |
| Mary's Songs | mary.wav | Jazz, David S... | Mary | 6 |
| Lisa's Songs | lisa.wav | Pop, Altern... | Lisa | 6 |
| Bob & Mary | bm.wav | Jazz, Rock, ... | Bob, Mary | 6 |
| Bob & Lisa | bl.wav | Pop, Rock, ... | Bob, Lisa | 6 |
| Mary & Lisa | ml.wav | Pop, Jazz, ... | Mary, Lisa | 6 |
| Bob, Mary & Lisa | bml.wav | Pop, Rock, ... | Bob, Mary, Lisa | 5 |
| Relaxation | relax.wav | New Age, Jazz | Bob, Mary, Lisa | 6 |
| Background | bgnd.wav | Classical | Bob, Mary, Lisa | 6 |
| ⋮ | ⋮ | ⋮ | ⋮ | ⋮ |

700

Fig. 7

METHOD AND APPARATUS FOR SCHEDULING MUSIC FOR SPECIFIC LISTENERS

TECHNICAL FIELD

The present invention relates to music playback systems and, more particularly, to a music controller that selects music based on one or more listeners.

BACKGROUND

Carrying and storing multiple music compact discs (CDs), digital versatile discs (DVDs), and/or cassette tapes is tedious, especially for listeners having a large music collection. By using a music encoding algorithm to encode music in an encoded audio format, such as Windows Media Audio (WMA) or MPEG Layer 3 (MP3), listeners can store music, in encoded form, on a computer or a portable music player. Once the music has been encoded into the particular audio format (or downloaded in the encoded audio format from a music server or other source), the listener is no longer required to carry or keep track of multiple CDs, DVDs, and/or cassette tapes.

Existing systems for playing encoded music assume that one person is listening to the music (e.g., the owner of the computer or portable music player). These existing systems allow the listener to create playlists; i.e., listings of songs to be played in a particular sequence. However, these existing systems do not allow a listener to rate different songs or albums. Furthermore, these existing systems are not capable of selecting music that is acceptable to two or more listeners. As mentioned above, these existing systems assume that a single listener is using the system and, therefore, do not contemplate groups of simultaneous listeners.

The system described herein addresses these and other problems by providing a music controller that selects music based on the preferences of the current listening group.

SUMMARY

The system and methods described herein schedule and play music based on the music preferences and/or ratings of one or more listeners. Music is selected that is favorable to all current listeners. Virtual radio stations allow the choice of music selections based on the different combinations of listeners and/or different music styles desired.

A particular embodiment selects a music library containing multiple music albums, in which each music album contains multiple songs. This embodiment also identifies listener preferences associated with a first listener and identifies listener preferences associated with a second listener. A music schedule is generated that contains multiple songs acceptable to the first listener and the second listener.

In one embodiment, a music controller plays songs from the music schedule.

In another embodiment, the listener preferences include ratings of music albums contained in the music library.

In other embodiments, the listener preferences include ratings of songs contained in the music library.

In a particular embodiment, the music schedule is generated such that songs with a higher ranking are played more frequently than songs with a lower ranking.

BRIEF DESCRIPTION OF THE DRAWINGS

FIG. 4 illustrates a portion of an example music library index.

FIG. 5 illustrates a portion of a table identifying listener music preferences for particular artists and listener ratings for particular albums.

FIG. 6 illustrates a table identifying listener ratings of particular songs.

FIG. 7 illustrates a table identifying various virtual radio stations and the attributes associated with each station.

DETAILED DESCRIPTION

The system and methods described herein schedule and playback music based on the music preferences and ratings of one or more current listeners. Music is selected that is acceptable to all current listeners. Virtual radio stations allow the choice of music selections based on the different combinations of listeners and/or different music styles desired.

Figure 1:
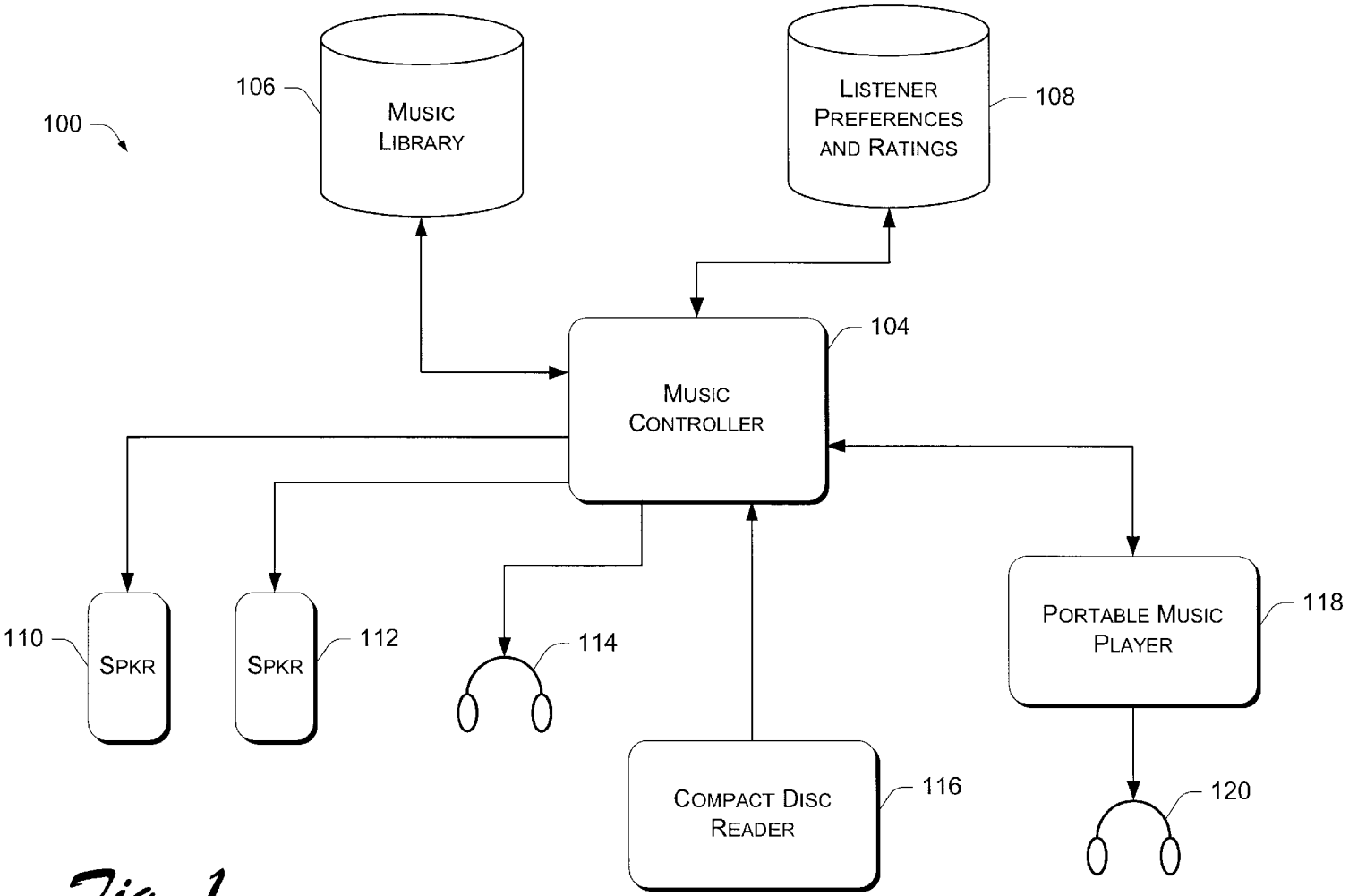
FIG. 1 illustrates an exemplary environment in which a music controller interacts with multiple associated devices.

FIG. 1 illustrates an exemplary environment 100 in which a music controller 104 interacts with multiple associated devices. Music controller 104 selects music for playback based on the musical preferences of the current listeners. Music controller 104 may be a computer system or other processing system capable of selecting music based on user preferences. In one embodiment, music controller 104 is part of a stereo system capable of implementing the procedures described herein.

Music controller 104 is coupled to a music library 106, which contains one or more songs stored, for example, in a digitally encoded format, such as Windows Media Audio (WMA) from Microsoft Corporation of Redmond, Wash., MPEG Layer 3 (MP3), developed under the sponsorship of the Motion Picture Experts Group, or other encoded audio formats. The music stored in music library 106 may be downloaded in an encoded audio format from a music server coupled to the Internet or may be copied into the music library 106 from a music CD, or other medium, using an application such as a "ripper." Another program, referred to as an "encoder," converts the raw music data into an encoded format (WMA, MP3, etc.). A particular "ripper" may copy and encode the raw music data simultaneously. Music library 106 may be stored on a non-volatile storage device such as a hard drive or in a non-volatile memory device.

In an alternate embodiment of the invention, music library 106 is a CD jukebox or other device capable of storing multiple pre-recorded music media simultaneously. In another embodiment, all or a portion of music library 106 may be stored on a server coupled to the Internet. In this embodiment, certain music songs are retrieved, as needed, from the server via the Internet, while other songs are retrieved from the local storage device containing the local portion of the music library.

A database 108 contains listener music preferences and listener ratings of artists, albums, and individual songs. Database 108 contains preferences and ratings for multiple listeners, i.e., each listener that might listen to music selected and/or generated by music controller 104. Additional details regarding the content of database 108 are provided below.

A pair of speakers 110 and 112 are coupled to music controller 104. Speakers 110 and 112 produce music in response to signals received from music controller 104. Music controller 104 may contain the necessary circuits to generate signals to drive speakers 110 and 112, or an intermediate device (not shown) may receive, for example, digital music signals from music controller 104 and convert those signals into a format that is required to drive the speakers. Additionally, a pair of headphones 114 are coupled to music controller 104 to allow a listener to listen to music.

A compact disc reader 116 is also coupled to music controller 104 and provides raw music data to the music controller. Music controller 104 may convert the raw music data into an encoded format for storage in music library 106 or may play the music via speakers 110 and 112, or headphones 114. Compact disc reader 116 may be a CD-ROM drive, a compact disc player, or other device capable of reading data from a compact disc.

A portable music player 118, such as a Diamond RIO player, RCA Lyra player, or Pocket PC device, is coupled to music controller 104. Portable music player 118 is capable of receiving and storing encoded music files for future playback. In the environment of FIG. 1, music controller 104 may select music of interest to the user of portable music player 118 and download the selected music from music library 106 to the portable music player. A pair of headphones 120 is coupled to portable music player 118 and allows the user of the portable music player to listen to the music stored in the player.

Figure 2:
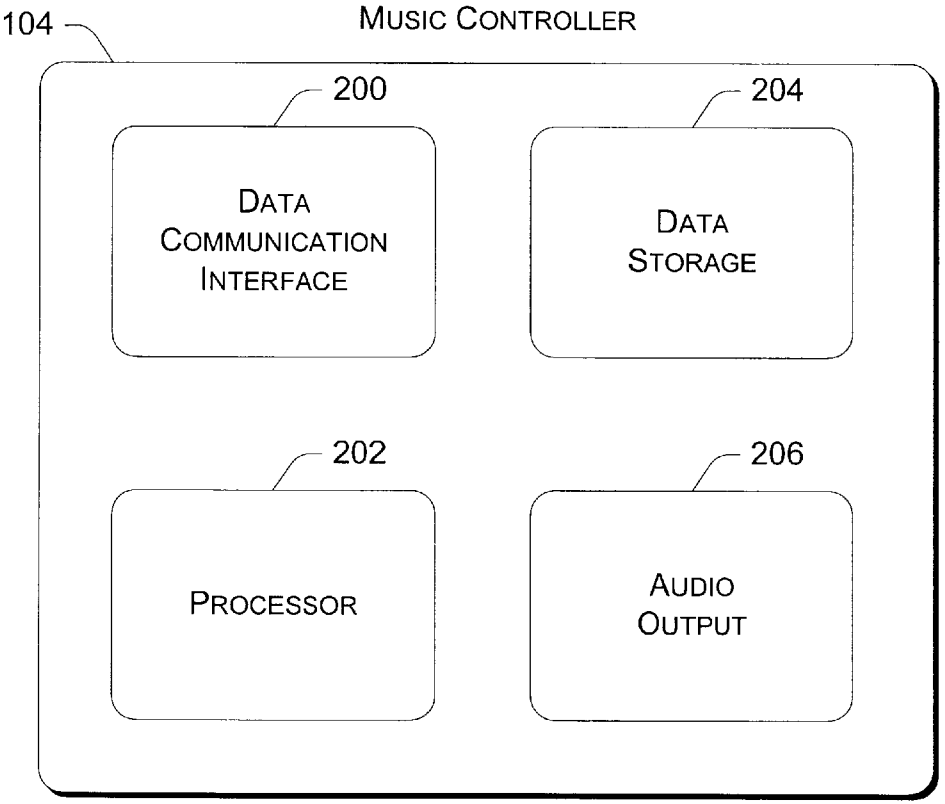
FIG. 2 is a block diagram showing exemplary components in a music controller.

FIG. 2 is a block diagram showing exemplary components in music controller 104. A data communication interface 200 allows music controller 104 to exchange data with other devices, such as other music controllers, CD reader 116, or portable music player 118, or to communicate data across a network, such as the Internet. A processor 202 performs the functions and operations necessary to perform the various procedures discussed herein. Data storage 204 stores data used and/or generated by processor 202 when performing various functions and operations. An audio output 206 generates an audio signal of a format required by speakers and/or headphones to generate sound, such as music. Other embodiments of music controller 104 may contain additional components or fewer components.

Figure 3:
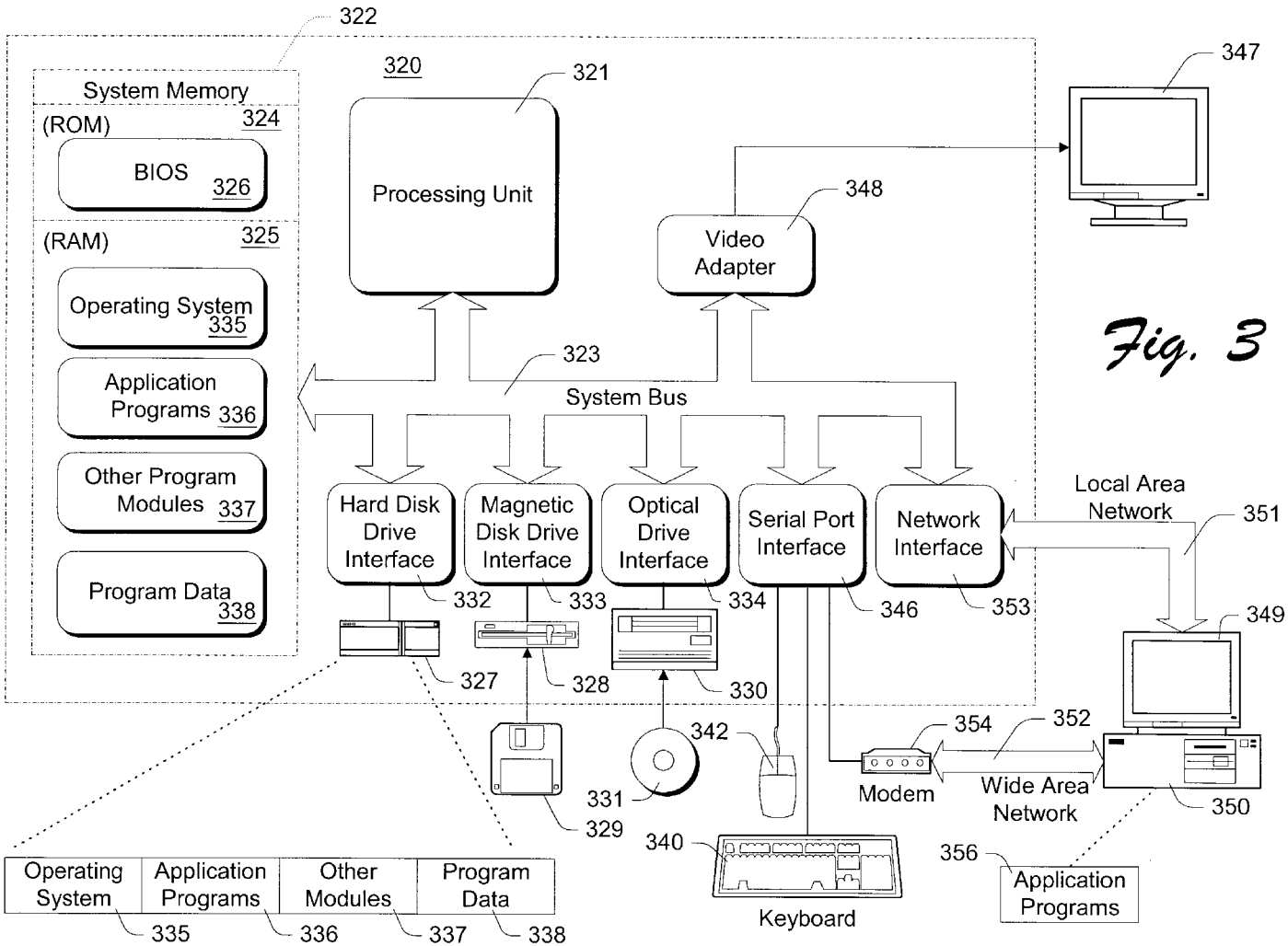
FIG. 3 is a block diagram showing pertinent components of a computer in accordance with the invention.

FIG. 3 is a block diagram showing pertinent components of a computer 320 in accordance with the invention. A computer such as that shown in FIG. 3 can be used, for example, to perform various procedures necessary to generate and maintain a music library, listener preferences and ratings, and select and play music based on current listeners, as described herein. Music controller 104 (FIG. 1) may contain some or all of the components shown in FIG. 3.

Computer 320 includes one or more processors or processing units 321, a system memory 322, and a bus 323 that couples various system components including the system memory 322 to processors 321. The bus 323 represents one or more of any of several types of bus structures, including a memory bus or memory controller, a peripheral bus, an accelerated graphics port, and a processor or local bus using any of a variety of bus architectures. The system memory 322 includes read only memory (ROM) 324 and random access memory (RAM) 325. A basic input/output system (BIOS) 326, containing the basic routines that help to transfer information between elements within computer 320, such as during start-up, is stored in ROM 324.

Computer 320 further includes a hard disk drive interface 332 coupled to system bus 323 and a hard disk drive 327. Hard disk drive 327 is for reading from and writing to a hard disk (not shown). A magnetic disk drive interface 333 is coupled to system bus 323 and a magnetic disk drive 328. Magnetic disk drive 328 is for reading from and writing to a removable magnetic disk 329. An optical drive interface 334 is coupled to system bus 323 and an optical disk drive 330. Optical disk drive 330 for reads from or writes to a removable optical disk 331 such as a CD ROM or other optical media. The drives and their associated computer-readable media provide nonvolatile storage of computer-readable instructions, data structures, program modules and other data for computer 320. Although the exemplary environment described herein employs a hard disk, a removable magnetic disk 329 and a removable optical disk 331, it should be appreciated by those skilled in the art that other types of computer-readable media which can store data that is accessible by a computer, such as magnetic cassettes, flash memory cards, digital video disks, random access memories (RAMs), read only memories (ROMs), and the like, may also be used in the exemplary operating environment.

A number of program modules may be stored on the hard disk 327, magnetic disk 329, optical disk 331, ROM 324, or RAM 325, including an operating system 335, one or more application programs 336, other program modules 337, and program data 338. A user may enter commands and information into computer 320 through input devices such as a keyboard 340 and a pointing device 342. Other input devices (not shown) may include a microphone, joystick, game pad, satellite dish, scanner, or the like. These and other input devices are connected to the processing unit 321 through a serial port interface 346 that is coupled to the bus 323. A monitor 347 or other type of display device is also connected to the bus 323 via an interface, such as a video adapter 348. In addition to the monitor, personal computers typically include other peripheral output devices (not shown) such as speakers and printers.

Computer 320 commonly operates in a networked environment using logical connections to one or more remote computers, such as a remote computer 349. The remote computer 349 may be another personal computer, a server, a router, a network PC, a peer device or other common network node, and typically includes many or all of the elements described above relative to computer 320, although only a memory storage device 350 has been illustrated in FIG. 3. Remote computer 349 may include one or more application programs 356 stored in the memory storage device 350. The logical connections depicted in FIG. 2 include a local area network (LAN) 351 and a wide area network (WAN) 352. Such networking environments are commonplace in offices, enterprise-wide computer networks, intranets, and the Internet.

When used in a LAN networking environment, computer 320 is connected to the local network 351 through a network interface or adapter 353. When used in a WAN networking environment, computer 320 typically includes a modem 354 or other means for establishing communications over the wide area network 352, such as the Internet. The modem 354, which may be internal or external, is connected to the bus 323 via the serial port interface 346. In a networked environment, program modules depicted relative to the personal computer 320, or portions thereof, may be stored in the remote memory storage device. It will be appreciated that the network connections shown are exemplary and other means of establishing a communications link between the computers may be used.

Generally, the data processors of computer 320 are programmed by means of instructions stored at different times in the various computer-readable storage media of the computer. Programs and operating systems are typically distributed, for example, on floppy disks or CD-ROMs. From there, they are installed or loaded into the secondary memory of a computer. At execution, they are loaded at least partially into the computer's primary electronic memory. The invention described herein includes these and other various types of computer-readable storage media when such media contain instructions or programs for implementing the steps described herein in conjunction with a microprocessor or other data processor. The invention also includes the computer itself when programmed according to the methods and techniques described herein.

For purposes of illustration, programs and other executable program components such as the operating system are illustrated herein as discrete blocks, although it is recognized that such programs and components reside at various times in different storage components of the computer, and are executed by the data processor(s) of the computer.

Alternatively, the invention can be implemented in hardware or a combination of hardware, software, and/or firmware. For example, one or more application specific integrated circuits (ASICs) could be programmed to carry out the invention.

FIG. 4 illustrates a portion of an example music library index 400, which contains information regarding multiple songs from multiple artists stored in the music library. Music library index 400 may contain information related to any number of songs from any number of artists covering any number of genres. The example of FIG. 4 shows a small sample of music contained in music library index 400. Music library index 400 is shown as a table in which each row of the table is associated with a particular song. A first column 402 identifies the genre of each song (e.g., rock, jazz, classical, country, new age, etc.). A second column 404 identifies the artist associated with the song and a third column 406 identifies the name of the album on which the song is contained. A fourth column 408 identifies the title of the particular song and a fifth column 410 identifies a pointer to where the song is stored (e.g., the location of the WMA or MP3 data file). The song may be stored, for example, in a music database coupled to the music controller 104 (such as music library 106) or in a database in a web server coupled to the music controller via the Internet.

The index 400 may contain all songs from a particular album or only a few songs, depending on the preferences of the user when generating or editing the music library. Although FIG. 4 shows the storage of the index 400 in a tabular format, the music library index may use any data storage technique and any type of data structure to store the music information.

FIG. 5 illustrates a portion of a table 500 identifying listener music preferences for particular artists and listener ratings for particular albums. Table 500 may contain preferences and ratings for multiple listeners. Alternatively, a separate table 500 may be used for each listener. A first column 502 identifies the listener to which the preferences and/or ratings are associated. The first five rows of table 500 contain preferences and ratings associated with listener "Bob", and the next four rows contain preferences and ratings associated with listener "Mary". A second column 504 identifies an artist's name. A third column 506 identifies the name of a music album associated with the artist in column 504. Each album rated by a particular listener is identified in a separate row of table 500. The associated album rating is identified in a fourth column 508. In this example, the album name and the album rating entries are empty for the artists "Utopia" and "Acme Gangsters", indicating that the artist is disliked by Bob. Similarly, the album name and the album rating entries are empty for the artist "Gold Horses", indicating that Mary dislikes the artist.

In a particular embodiment, the album rating can be 0, 1, 2, 3, 4, or 5. A "0" rating indicates that the listener dislikes the album (but may like the artist). Thus, a particular listener may like a particular artist, but dislike one of the artist's albums. The rating system described above allows the listener to prevent playback of the disliked album without preventing playback of all albums from the particular artist. The remaining ratings (1–5) indicate how well the user rates the album. A "1" indicates a slight interest in the album and a "5" indicates that the album is one of the listener's favorite albums. If a listener does not rate a particular album in the music library, then the music controller assigns a default album rating of "3."

FIG. 6 illustrates a table 600 identifying listener ratings of particular songs. The individual song ratings are distinct from the album ratings discussed above. If an album is rated "0" by a listener, then the listener does not rate any of the individual songs on the album, because the "0" indicates that the entire album is disliked. A first column 602 of table 600 identifies the listener to which the song ratings are associated. A second column 604 identifies the name of the artist and album on which the rated song is located. If the same song is located on different albums, the listener can either rate both songs or mark one of the songs as "do not play".

A third column 606 identifies the title of the song and a fourth column 608 identifies the listener's rating of that song on a scale of 0–5. On the rating scale, "0" indicates that the listener dislikes the song. The remaining ratings 1–5 indicate how well the listener likes the song ("1" indicates little interest in the song and "5" indicates that the song is one of the listener's favorites).

As shown in table 600, different listeners may assign different ratings to the same song. For example, Bob rates the song "Panama" a "3", while Mary rates the same song a "2". If a listener does not rate a particular song, the music controller may assign a default rating of "3" to the unrated song. In another embodiment, listeners do not rate individual songs. Instead the listeners rate artists and albums, but not particular songs. In this embodiment, songs are rated globally rather than by each listener.

FIG. 7 illustrates a table 700 identifying various virtual radio stations and the attributes associated with each station. A virtual radio station selects music for playback based on various preferences and ratings associated with the listeners of the virtual radio station. The music played by a virtual radio station is selected such that all music is favorable to all listeners; i.e., no disliked artists, disliked albums, or disliked songs are played.

Table 700 includes a first column 702 that identifies the names of each virtual radio station. A second column 704 identifies a station identifier file, such as an audible "wav" file, that identifies the selected virtual radio station. For example, the "wav" file associated with radio station "Bob's Songs" may play a brief audible introduction, such as "This is Bob's Radio Station." This audible identifier of the virtual radio station allows the user to cycle through the various virtual radio stations (e.g., using a remote control device) and select the desired station without having to view a computer monitor or other display device.

A third column 706 identifies the source of the music associated with the virtual radio station. Virtual radio stations may access music from one or more music libraries. The music source 706 can specify a list of genres, artists, and/or albums that may be played by the virtual radio station.

A fourth column 708 identifies the listeners of each virtual radio station. A fifth column 710 identifies the minimum candidate rating that a particular song must satisfy to be played by the virtual radio station. Calculation of candidate ratings is discussed below.

Figure 8:
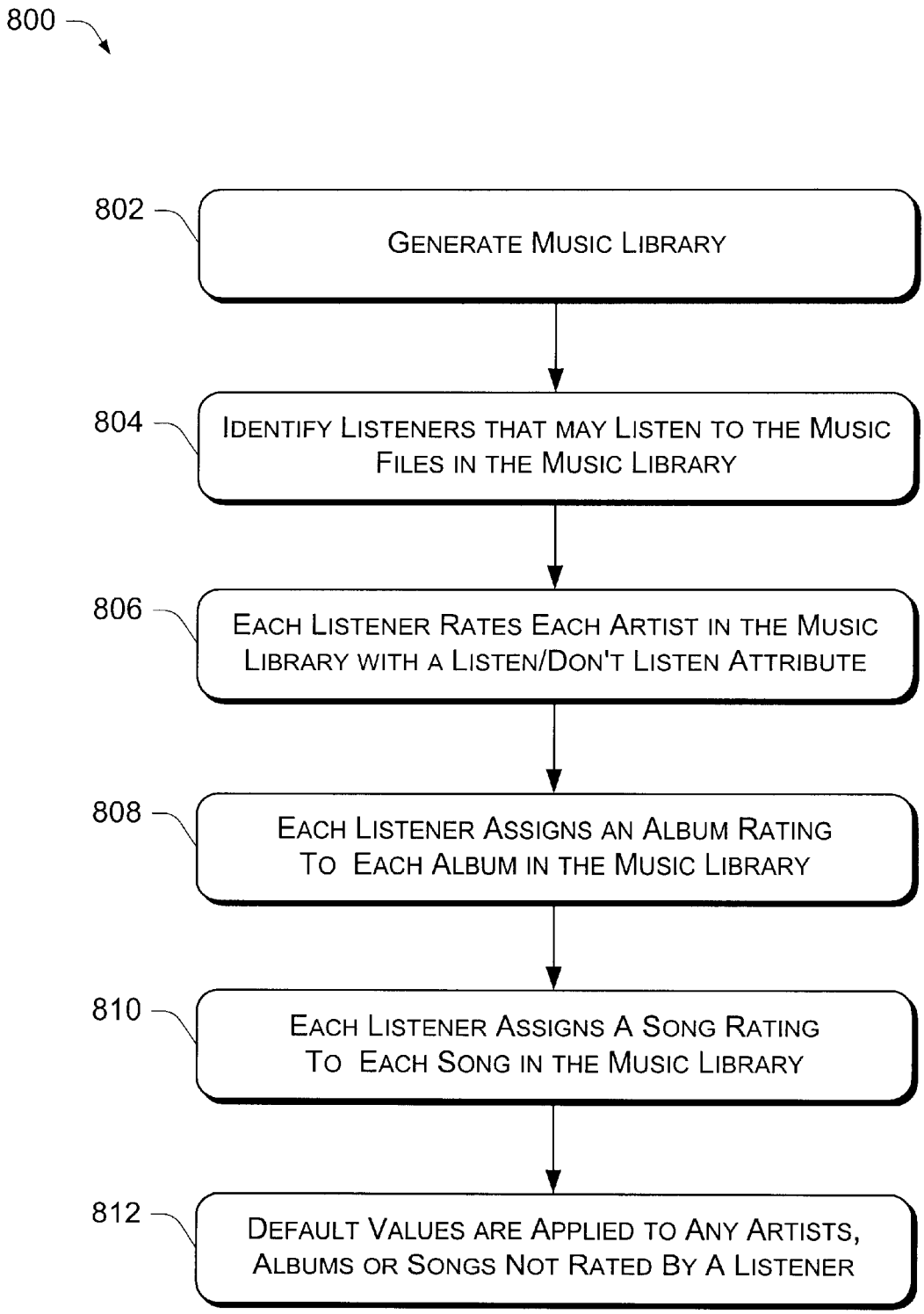
FIG. 8 is a flow diagram illustrating a procedure for generating a music library and assigning ratings to the music in the music library.

FIG. 8 is a flow diagram illustrating a procedure 800 for generating a music library and assigning ratings to the music in the music library. At block 802, the music library is generated by populating the library with multiple songs from different artists and albums. For example, music may be downloaded across a network, such as the Internet, from a music server or other device that stores music files. Alternatively, music may be copied into the music library from a pre-recorded medium, such as a compact disc (CD), digital versatile disc (DVD), or a cassette tape.

The procedure identifies listeners that may listen to one or more music files in the music library (block 804). Each listener of the music system rates each artist in the music library with a listen/don't listen attribute (block 806). Each listener also assigns an album rating to each album in the music library (block 808), except albums associated with artists having a "don't listen" attribute set by that listener. Finally, each listener assigns a song rating to each song in the music library (block 810), except songs associated with artists or albums having a "don't listen" attribute set by that listener. Default values are applied to any artists, albums, or songs that are not rated by a listener (block 812). For an artist, the default value is typically "listen." For an album or song, the default value is typically "3", which is midway between "1" and "5" on the rating scale. The various attributes are stored in one or more tables, of the types discussed above with reference to FIGS. 5 and 6.

Figure 9:
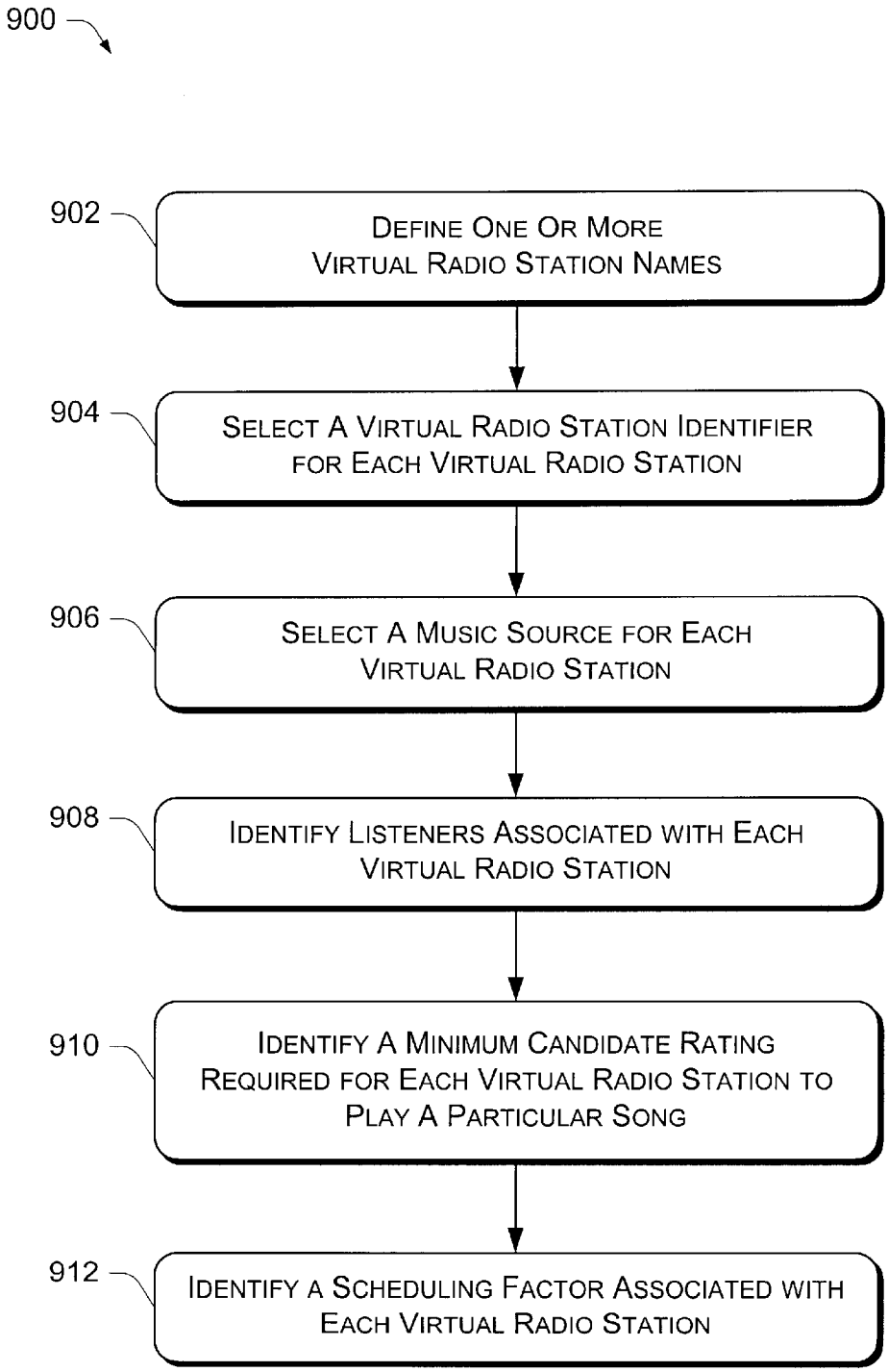
FIG. 9 is a flow diagram illustrating a procedure for creating a virtual radio station.

FIG. 9 is a flow diagram illustrating a procedure 900 for creating a virtual radio station. At block 902 of procedure 900, one or more virtual radio station names are defined. The next step selects a virtual radio station identifier for each virtual radio (block 904). For example, the identifier may be an audible file that announces the name of the virtual radio station when played. A music source is then selected for each virtual radio station (block 906). The next step identifies listeners associated with each virtual radio station (block 908). Next, the procedure identifies a minimum candidate rating required for each virtual radio station to play a particular song (block 910). Finally, the procedure identifies a scheduling factor (discussed below) associated with each virtual radio station. The resulting virtual radio station data is stored in a table, such as table 700 discussed above with respect to FIG. 7.

Figure 10:
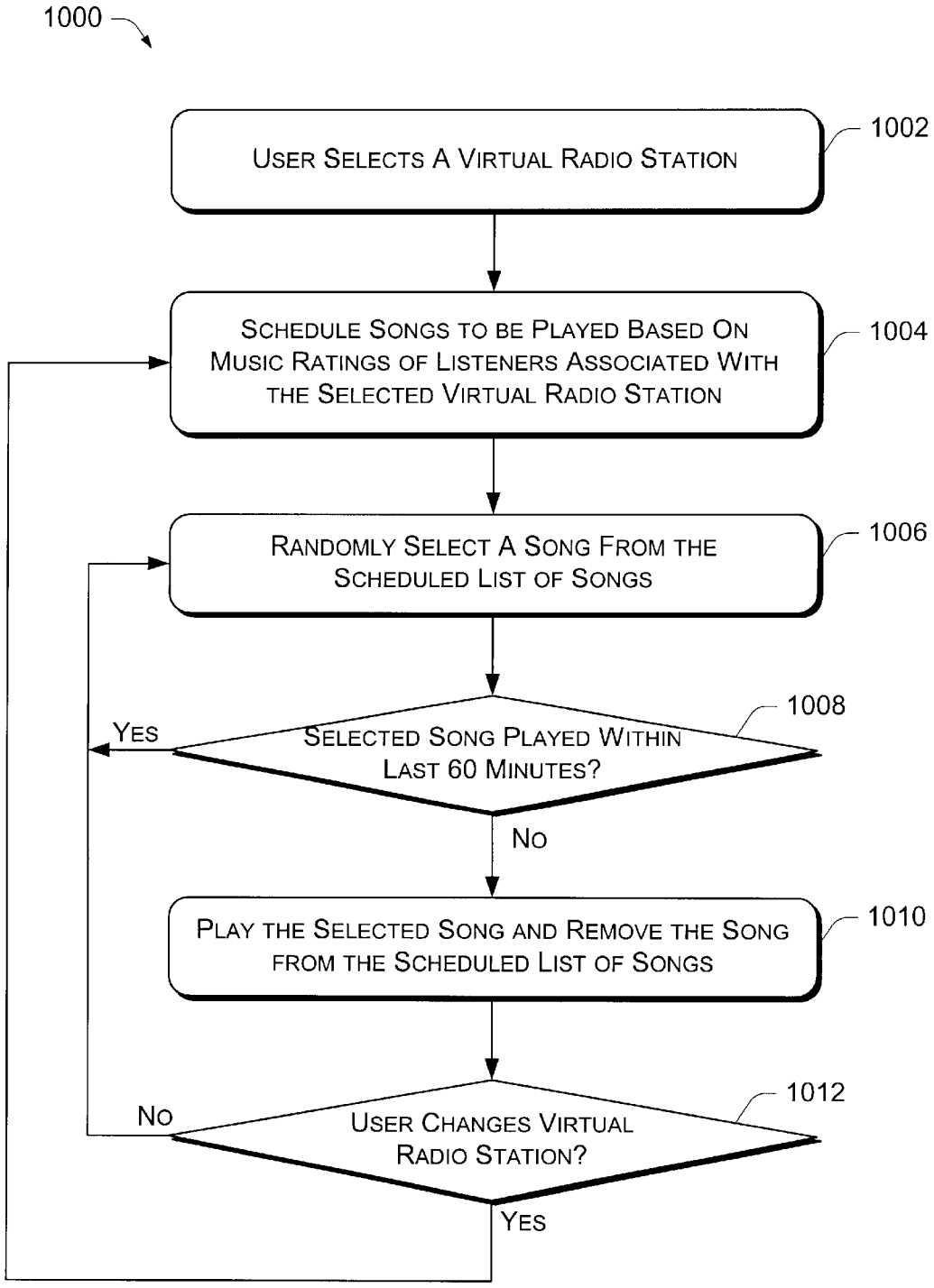
FIG. 10 is a flow diagram illustrating a procedure for playing music based on selected virtual radio station.

FIG. 10 is a flow diagram illustrating a procedure 1000 for playing music based on a selected virtual radio station. Initially, a user selects a virtual radio station (block 1002). The music controller schedules a list of songs to be played based on the music ratings of listeners associated with the selected virtual radio station (block 1004). The music controller randomly selects a song from the scheduled list of songs (block 1006). Next, the procedure 1000 determines whether the selected song has already been played within the last sixty minutes (block 1008). Sixty minutes is provided as an example; alternate embodiments may use any minimum time period between songs before repeating. If the selected song has been played within the last sixty minutes, then the procedure returns to block 1006 to select another song from the scheduled list of songs. If the selected song has not been played within the last sixty minutes, then the procedure plays the selected song (block 1010). The selected song is then removed from the scheduled list of songs. When the scheduled list of songs is empty, a new scheduled list of songs is generated. Block 1012 determines whether the user has changed the virtual radio station. If the virtual radio station has not been changed, then the procedure returns to block 1006 to randomly select another song from the scheduled list of songs. If the virtual radio station has been changed, then the procedure returns to block 1004 to generate a new schedule of songs to be played based on the music ratings of listeners associated with the new virtual radio station.

Figure 11:
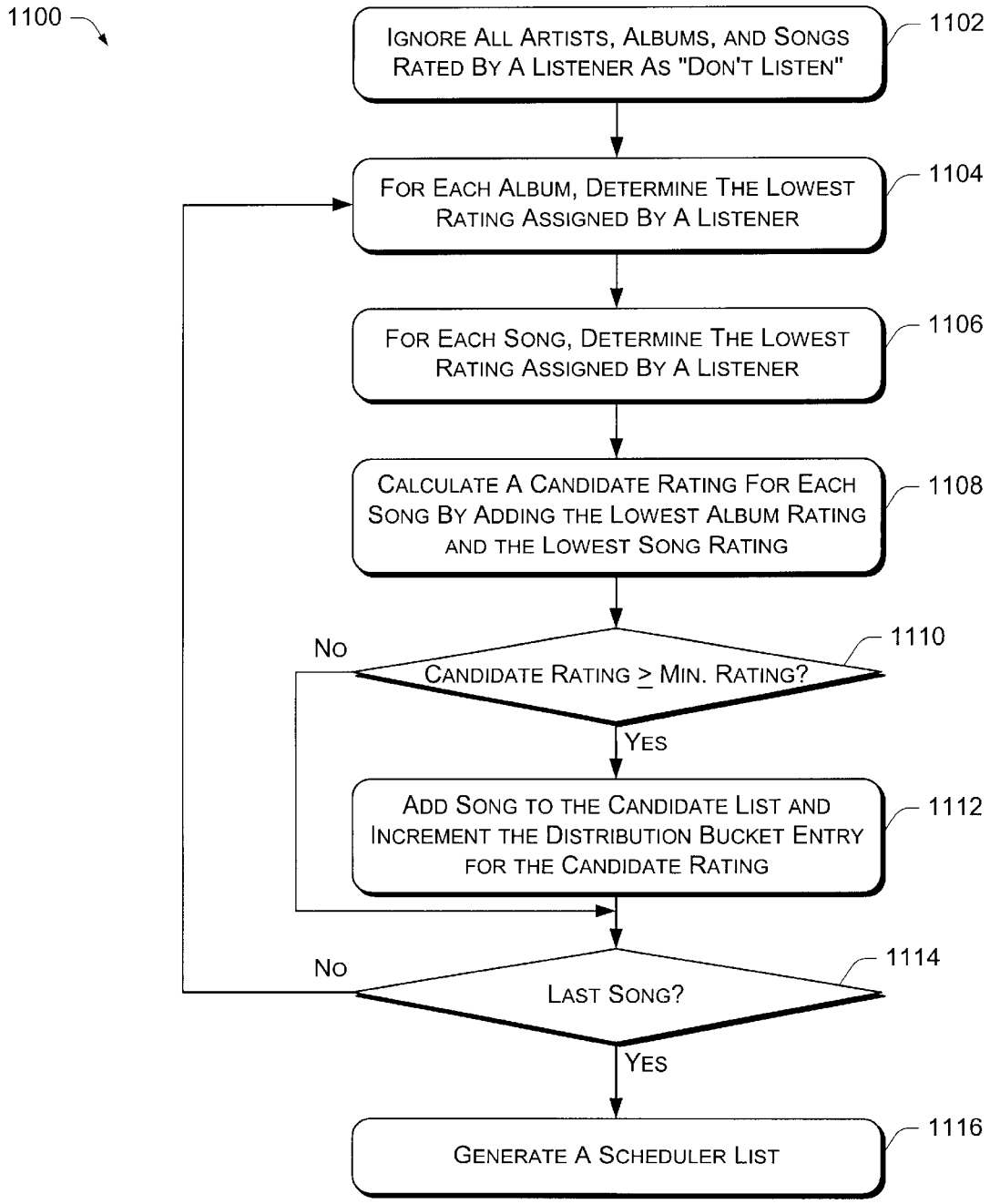
FIG. 11 is a flow diagram illustrating a procedure for scheduling songs to be played on a particular virtual radio station.

FIG. 11 is a flow diagram illustrating a procedure 1100 for scheduling songs to be played on a particular virtual radio station. When scheduling music for a particular virtual radio station, the music controller creates a list of songs that satisfy the preferences of the listeners and other criteria associated with the virtual radio station. Only the preferences of listeners associated with the selected virtual radio station are considered when performing procedure 1100. When scheduling music, procedure 1100 ignores all artists, albums, and songs rated by at least one listener as "don't listen" (block 1102). For each album in the music library, the music controller determines the lowest rating assigned by a listener (block 1104). Next, for each song in the music library, the music controller determines the lowest rating assigned by a listener (block 1106). A candidate rating is calculated for each song by adding the lowest album rating for the album containing the song and the lowest rating for the song (block 1108).

Using the example tables discussed above with respect to FIGS. 5 and 6, the album rating can range from 1 to 5 and the song rating can range from 1 to 5. Thus, the candidate rating for a particular song can range from 2 to 10. Note that if a particular album or song is rated "0" by any listener associated with the virtual radio station, it is ignored at block 1102 and not considered a candidate for playback.

Next, procedure 1100 determines whether the song's candidate rating is greater than or equal to the minimum rating associated with the virtual radio station (block 1110). The song is added to the candidate list if the candidate rating is greater than or equal to the minimum rating of the virtual radio station (block 1112). Additionally, the distribution bucket entry for the candidate rating is incremented. The distribution bucket maintains the number of songs added to the candidate list with particular candidate rating values. The minimum rating associated with each virtual radio station is identified in column 710 of table 700 in FIG. 7. Thus, if the virtual radio station has a minimum rating of "6" and the candidate rating is "5", then the song is not added to the candidate list. However, if the virtual radio station has a minimum rating of "6" and the candidate rating is "6", then the song is added to the candidate list. Additionally, the distribution bucket entry for candidate rating "6" is incremented to indicate that the candidate list contains another song with a candidate rating of "6". If the minimum rating for a particular virtual radio station is "6", then there are five possible distribution bucket entries: 6, 7, 8, 9, and 10.

Block 1114 of procedure 1100 determines whether the current song is the last song in the music library. If not, the procedure returns to block 1104 to rate i the next song in the library. After the last song has been reached, a scheduler list is generated (block 1116). In one embodiment, each song is copied from the candidate list to the scheduler list. Thus, each song in the candidate list appears once in the scheduler list.

In another embodiment, songs with higher candidate ratings are copied from the candidate list to the scheduler list multiple times, based on a scheduling factor X. The scheduling factor determines the preference given to higher candidate ratings when scheduling the songs. The scheduler attempts to create a distribution of songs such that for every song rating R in the scheduler list, there are X*R songs rated R+1 in the scheduler list. Typically, a different number of songs are associated with each candidate rating. Therefore, a multiplier M is used for each candidate rating. M is defined as:

$$M(R)=X^{*}\ (\text{number of songs rated } R-1/\text{number of songs rated } R)$$

If R is the lowest candidate rating, then M(R)=1.

In a particular example, the value of X can vary from 1.0 to 2.0 in 0.25 increments. Thus, possible values for X are 1.00, 1.25, 1.50, 1.75, and 2.00. In this example, songs have a candidate rating of "6", "7", or "8". If X=1.00, then for each candidate rating "6" song, the scheduler list should include one candidate rating "7" song and one candidate rating "8" song. If X=2.00, then for each candidate rating "6" song, the scheduler list should include two (X*1) candidate rating "7" songs and four (X*X) candidate rating "8" songs. If a fourth candidate rating "9" was available, then with X=2.00, the fourth candidate rating would require eight entries (X*X*X) for each candidate rating "6" entry. In the example discussed above, five different scheduling factors are used. However, alternate embodiments may utilize any number of different scheduling factors.

Table 1 below illustrates example calculations for determining the number of songs for each candidate rating to include in the scheduler list. In this example, X=2.00.

TABLE 1

| Candidate Rating | Bucket Count (# Songs) | Multi-plier | Total Count (Bucket + Multiplier) |
|---|---|---|---|
| 6 | 1525 | 1 | 1525 |
| 7 | 651 | 4.69 | 3053 |
| 8 | 432 | 14.12 | 6100 |

For the smallest candidate rating, the multiplier is always 1, and each song is copied to the scheduler list once. For each higher rating, the total count is calculated by using the total count of the smaller rating and multiplying it by the scheduling factor X. This value indicates the number of songs that are needed for that candidate rating. The total count is then divided by the bucket count to determine the multiplier M. The song is then copied to the scheduler list M times (using only the integer portion of the multiplier M). A uniformly distributed random number is generated between 0 and 1. If the random number is less than the non-integer portion of the multiplier M, then the song is added to the scheduler list an additional time. If the random number is greater than the non-integer portion of the multiplier M, then the scheduler list remains unchanged.

The multiplier M differs from the scheduling factor because of the difference in bucket counts from one rating to the next. Since there are fewer songs rated 7 than are rated 6, more than twice the number of songs are copied to generate an X equal to 2.

Table 2 below illustrates another example calculation for determining the number of songs for each candidate rating to include in the scheduler list. In this example, X=1.50.

TABLE 2

| Candidate Rating | Bucket Count (# Songs) | Multi-plier | Total Count (Bucket + Multiplier) |
|---|---|---|---|
| 6 | 1525 | 1 | 1525 |
| 7 | 651 | 3.51 | 2288 |
| 8 | 432 | 7.94 | 3432 |

Once the scheduler list is generated, the music controller randomly selects a group of songs (e.g., 20 songs) from the scheduler list and deletes those songs from the scheduler list. After playing that group of songs, the music controller randomly selects another group of songs from the scheduler list. This process is repeated until the scheduler list is empty or contains a small number of songs (e.g., less than 20 songs). When the scheduler list is empty, or almost empty, the music controller generates a new scheduler list. Each time the virtual radio station is changed, a new scheduler list is generated.

As discussed above, album and song ratings are provided by each listener. This process can be time-consuming and tedious, especially in the case of a large music library. In an alternate embodiment of the invention, listeners can download at least a portion of the music ratings from another source. The music ratings may be determined based on how the listener has rated similar songs or albums. For example, when a listener adds a new album to the music library, they may download album and song ratings for that album that are based on ratings provided by other purchasers of the same album.

An external music source may maintain a database of reviews (e.g., ratings) provided by all listeners or purchasers. When determining a rating for a new listener, the database generates a "match coefficient" that describes how closely the new listener's music collection matches the music collection of other reviewers. This match coefficient may be the number of albums that the two individuals each have in their music collection. The rating used for the new listener is selected to match the rating assigned by another individual having the best match coefficient. Alternatively, the system may calculate an average correlation coefficient that considers all reviews and generates a rating by weighting the different reviews accordingly.

Thus, a system and method has been described that selects music for playback based on the preferences of one or more listeners. Although the description above uses language that is specific to structural features and/or methodological acts, it is to be understood that the invention defined in the appended claims is not limited to the specific features or acts described. Rather, the specific features and acts are disclosed as exemplary forms of implementing the invention.

What is claimed is:

1. A method comprising:

selecting a music library containing a plurality of music albums, each music album containing a plurality of songs;

identifying listener preferences associated with a present listener; and generating a music schedule containing a plurality of songs acceptable to the listener.

2. A method as recited in claim 1 wherein the listener preferences include ratings of music albums contained in the music library.

3. A method as recited in claim 1 wherein the listener preferences include ratings of songs contained in the music library.

4. A method as recited in claim 1 wherein retrieving a music library includes retrieving at least a portion of the music library from a music server.

5. A method as recited in claim 1 wherein retrieving a music library includes retrieving at least a portion of the music library from a web server coupled to the Internet.

6. A method as recited in claim 1 further comprising playing songs from the music schedule.

7. One or more computer-readable memories containing a computer program that is executable by a processor to perform the method recited in claim 1.

8. A method comprising:

selecting'a music library containing a plurality of music albums, each music album containing a plurality of songs;

identifying listener preferences associated with a first listener;

identifying listener preferences associated with a second listener; and generating a music schedule containing a plurality of songs acceptable to the first listener and the second listener.

9. A method as recited in claim 8 further comprising playing songs from the music schedule.

10. A method as recited in claim 8 wherein the listener preferences associated with the first listener and the second listener include ratings of music albums contained in the music library.

11. A method as recited in claim 8 wherein the listener preferences associated with the first listener and the second listener include ratings of songs contained in the music library.

12. A method as recited in claim 8 wherein retrieving a music library includes retrieving at least a portion of the music library from a music server.

13. A method as recited in claim 8 wherein retrieving a music library includes retrieving at least a portion of the music library from a web server coupled to the Internet.

14. A method as recited in claim 8 wherein the music schedule is generated such that songs with a higher ranking are played more frequently than songs with a lower ranking.

15. A method as recited in claim 8 wherein the music schedule is generated by selecting songs having a combined rating at least equal to a threshold value.

16. A method as recited in claim 8 wherein the music library stores music in an encoded audio format.

17. One or more computer-readable memories containing a computer program that is executable by a processor to perform the method recited in claim 8.

18. A method of creating a music library, the method comprising:

copying a plurality of music files to the music library;

identifying listeners that may listen to the plurality of music files;

each identified listener assigning ratings to at least a portion of the plurality of music files; and generating a music schedule based on the listener-assigned ratings.

19. A method as recited in claim 18 wherein the ratings assigned by each identified listener include ratings of music albums contained in the music library.

20. A method as recited in claim 18 wherein the ratings assigned by each identified listener include ratings of songs contained in the music library.

21. A method as recited in claim 18 wherein the ratings assigned by each identified listener include ratings of artists whose music is contained in the music library.

22. A method of creating a virtual radio station, the method comprising:

identifying a name associated with the virtual radio station;

identifying at least one music library associated with the virtual radio station;

identifying at least one listener associated with the virtual radio station; and identifying a minimum candidate rating required for the virtual radio station to play a particular song.

23. A method as recited in claim 22 wherein the virtual radio station plays songs that meet the minimum candidate rating.

24. A method as recited in claim 22 further comprising identifying a virtual radio station identifier associated with the virtual radio station.

25. A method as recited in claim 22 wherein the virtual radio station identifier has an associated sound file.

26. One or more computer-readable media having stored thereon a computer program that, when executed by one or more processors, causes the one or more processors to:

select a music library containing a plurality of music albums, each music album containing a plurality of songs;

identify listener preferences associated with a first listener;

identify listener preferences associated with a second listener; and generate a music schedule containing a plurality of songs acceptable to the first listener and the second listener.

27. One or more computer-readable media as recited in claim 26 wherein the listener preferences associated with the first listener and the second listener include ratings of music albums contained in the music library.

28. One or more computer-readable media as recited in claim 26 wherein the listener preferences associated with the first listener and the second listener include ratings of songs contained in the music library.

29. One or more computer-readable media as recited in claim 26 wherein the listener preferences associated with the first listener and the second listener include ratings of artists whose music is contained in the music library.

30. An apparatus comprising:

a music library containing a plurality of music albums, each music album containing a plurality of songs; and a music controller coupled to the music library to identify listener preferences associated with a first listener and identify listener preferences associated with a second listener, the music controller further to generate a music schedule containing a plurality of songs acceptable to the first listener and the second listener.

31. An apparatus as recited in claim 30 wherein the listener preferences associated with the first listener and the second listener include ratings of music albums contained in the music library.

32. An apparatus as recited in claim 30 wherein the listener preferences associated with the first listener and the second listener include ratings of songs contained in the music library.

33. An apparatus as recited in claim 30 wherein the listener preferences associated with the first listener and the second listener include ratings of artists whose music is contained in the music library.

34. An apparatus as recited in claim 30 wherein the music controller is further to play songs from the generated music schedule.

* * * * *